US008562462B2

(12) United States Patent
Yamamoto et al.

(10) Patent No.: US 8,562,462 B2
(45) Date of Patent: Oct. 22, 2013

(54) RACKET FRAME

(75) Inventors: Yosuke Yamamoto, Kobe (JP); Kuniyasu Horiuchi, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 0 days.

(21) Appl. No.: 13/537,524

(22) Filed: Jun. 29, 2012

(65) Prior Publication Data

US 2013/0029793 A1 Jan. 31, 2013

(30) Foreign Application Priority Data

Jul. 25, 2011 (JP) ..... 2011-162026

(51) Int. Cl.
*A63B 49/02* (2006.01)

(52) U.S. Cl.
USPC ..... 473/521; 473/537

(58) Field of Classification Search
USPC ..... 473/520–524, 537
See application file for complete search history.

(56) References Cited

U.S. PATENT DOCUMENTS 5,178,387 A 1/1993 Kuebler
5,538,243 A * 7/1996 Yamamoto et al. ..... 473/537
7,131,920 B2 * 11/2006 Ashino ..... 473/535
8,137,221 B2 * 3/2012 Ashino ..... 473/535
2013/0029793 A1 * 1/2013 Yamamoto et al. ..... 473/523

FOREIGN PATENT DOCUMENTS

JP 4-236973 A 8/1992
JP 2001286581 A * 10/2001 ..... A63B 49/10
JP 2002065904 A * 3/2002 ..... A63B 49/10
JP 2003-10362 A 1/2003
JP 2011015885 A * 1/2011 ..... A63B 49/02
JP 2013022361 A * 2/2013 ..... A63B 49/02

* cited by examiner

*Primary Examiner* — Raleigh W Chiu
(74) *Attorney, Agent, or Firm* — Birch, Stewart, Kolasch & Birch, LLP

(57) ABSTRACT

A racket frame 2 includes a body 4 and a first vibration-damping portion 6 fixed to the body 4. The body 4 includes a head 8, a shaft 12, a pair of throats 10 extending from the head 8 to the shaft 12, and a grip 14 connected to the shaft 12. The body 4 includes a second vibration-damping portion 18, and the material of the second vibration-damping portion 18 is different from the material of the first vibration-damping portion 6. The ratio (R2/R4) of a side pressure rigidity R2 to a throat rigidity R4 is 0.26 or greater, a moment of inertia around an axis at a position of 10 cm from a grip end is less than 300 kg·cm$^2$, and a vibration damping rate in an out-of-plane secondary mode is equal to or greater than 0.70 but equal to or less than 1.0.

10 Claims, 14 Drawing Sheets

RACKET FRAME

This application claims priority on Patent Application No. 2011-162026 filed in JAPAN on Jul. 25, 2011. The entire contents of this Japanese Patent Application are hereby incorporated by reference.

BACKGROUND OF THE INVENTION

1. Field of the Invention

The present invention relates to frames for tennis rackets and the like. Specifically, the present invention relates to racket frames that include vibration-damping portions.

2. Description of the Related Art

When a ball is hit with a tennis racket, vibrations are transmitted to the player. Some players feel uncomfortable with the vibrations. Players desire mild feel at impact. The vibrations can also cause tennis elbow.

There have been various proposals for damping the vibrations. JP4-236973 discloses a tennis racket that includes an elastic body in a grip thereof. The elastic modulus of the elastic body can contribute to vibration damping. JP2003-10362 discloses a tennis racket that includes a damper in a head thereof. The damper can contribute to vibration damping.

Players request tennis rackets to have desired resilience. When a ball is hit with a racket having excellent resilience, the ball can fly at a high speed. Players also request tennis rackets to have desired operability.

Tennis rackets having excellent resilience and operability are suitable to players who participate in competitions. However, tennis rackets having excellent resilience and operability generally have inferior vibration-damping performance.

SUMMARY OF THE INVENTION

An object of the present invention is to provide a racket frame having excellent vibration-damping performance, resilience, and operability.

A racket frame according to the present invention includes a body and a first vibration-damping portion fixed to the body. The body includes a head, a shaft, a pair of throats extending from the head to the shaft, and a grip connected to the shaft. The body includes a second vibration-damping portion. A material of the second vibration-damping portion is different from a material of the first vibration-damping portion. In the racket frame, a ratio (R2/R4) of a side pressure rigidity R2 to a throat rigidity R4 is equal to or greater than 0.26. A moment of inertia around an axis at a position of 10 cm from a grip end is less than 300 kg·cm$^2$. A vibration damping rate in an out-of-plane secondary mode is equal to or greater than 0.70 but equal to or less than 1.0.

Preferably, the first vibration-damping portion is formed from a fiber reinforced nylon. Preferably, the second vibration-damping portion is formed from an epoxy resin.

Preferably, the first vibration-damping portion is fixed to each throat, the shaft, or the grip, and the second vibration-damping portion is included in the head or each throat. Preferably, the first vibration-damping portion extends from each throat to the grip.

Preferably, the head includes a pair of second vibration-damping portions. These second vibration-damping portions are located so as to be symmetrical about the axis of the racket frame.

Each throat may include the second vibration-damping portion. These second vibration-damping portions are located so as to be symmetrical about the axis of the racket frame.

Preferably, the side pressure rigidity R2 is equal to or greater than 95 kgf/cm, and the throat rigidity R4 is equal to or less than 350 kgf/cm. Preferably, the ratio (R2/R4) is equal to or greater than 0.28. Preferably, the moment of inertia is less than 295 kg·cm$^2$.

DESCRIPTION OF THE PREFERRED EMBODIMENTS

The following will describe in detail the present invention, based on preferred embodiments with reference to the accompanying drawings.

Figure 1:
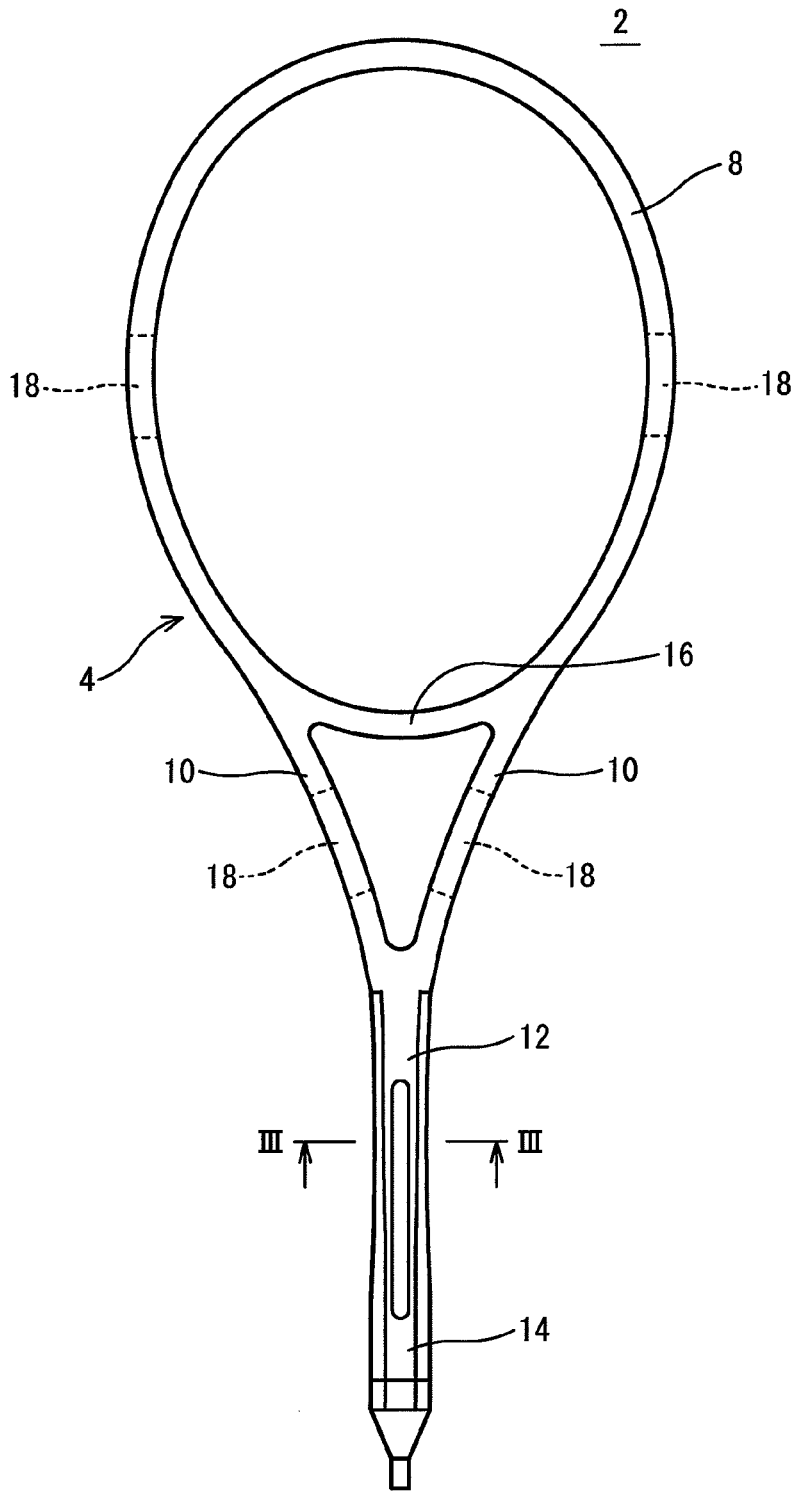
FIG. 1 is a front view of a racket frame according to one embodiment of the present invention.
Figure 2:
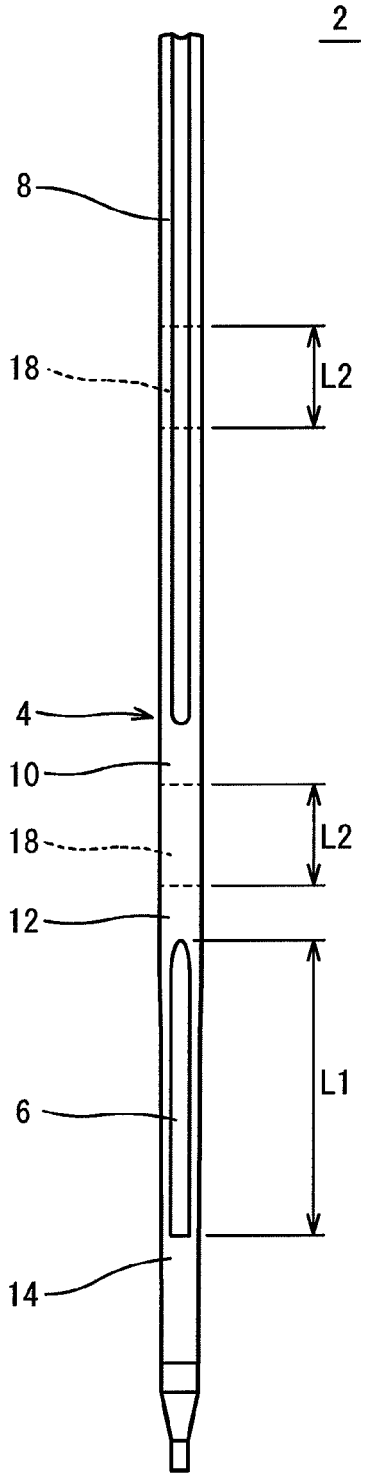
FIG. 2 is a side view of the racket frame in FIG. 1.
Figure 3:
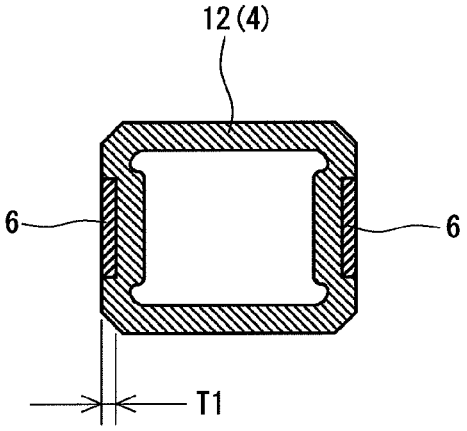
FIG. 3 is an enlarged cross-sectional view taken along the line in FIG. 1.

A racket frame 2 shown in FIGS. 1 to 3 includes a body 4 and two first vibration-damping portions 6. The body 4 includes a head 8, two throats 10, a shaft 12, and a grip 14. A grommet, a grip tape, an end cap, and the like are attached to the racket frame 2, and a gut is stretched on the racket frame 2, whereby a racket for regulation-ball tennis is obtained. In FIG. 1, the top-to-bottom direction is an axial direction of the racket frame 2.

The head 8 forms the contour of a ball-hitting face. The head 8 has a substantially elliptical front shape. One end of each throat 10 is connected to the head 8. Each throat 10 is connected at the vicinity of the other end thereof to the other throat 10. The throats 10 extend from the head 8 to the shaft 12. The shaft 12 extends from the location where the two throats 10 are connected to each other. The shaft 12 is formed so as to be integrally connected to the throats 10. The grip 14 is formed so as to be integrally connected to the shaft 12. The portion of the head 8 that is sandwiched between the two throats 10 is a yoke 16.

The body 4 is composed of fiber reinforced resinous layers. The matrix resin of the fiber reinforced resinous layers is an epoxy resin. The reinforced fiber of the fiber reinforced resinous layers is a carbon fiber. The reinforced fiber is a long fiber. As is obvious from FIG. 3, the body 4 is hollow. The body 4 is formed by winding a plurality of prepregs and curing the epoxy resin included in the prepregs.

The first vibration-damping portions 6 are fixed to the body 4. As shown in FIG. 3, recesses are formed in the body 4, and the first vibration-damping portions 6 are buried in the recesses. The first vibration-damping portions 6 are fixed to the body 4 by means of an adhesive.

The first vibration-damping portions 6 can be fixed to the throats 10, the shaft 12, or the grip 14. As is obvious from FIG. 2, in the present embodiment, the first vibration-damping portions 6 extend from the throats 10 to the grip 14.

Each first vibration-damping portion 6 is formed from a fiber reinforced nylon including a short fiber. A preferable short fiber is a carbon fiber. A preferable matrix is 66 nylon. The content of the short fiber in the fiber reinforced nylon is equal to or greater than 10% by weight but equal to or less than 30% by weight. The first vibration-damping portion 6 in which the content is equal to or greater than 10% by weight has a high elastic modulus and excellent dimensional accuracy. In this respect, the content is particularly preferably equal to or greater than 15% by weight. The first vibration-damping portion 6 in which the content is equal to or less than 30% by weight has excellent vibration-damping performance. In this respect, the content is preferably equal to or less than 25% by weight.

In the tennis racket in which the racket frame 2 is used, vibrations generated at hitting are damped by the first vibration-damping portions 6. The tennis racket has excellent feel at impact. With the tennis racket, tennis elbow is unlikely to occur.

What is indicated by a reference sign L1 in FIG. 2 is the length of the first vibration-damping portion 6. In light of vibration-damping performance, the length L1 is preferably equal to or greater than 5 cm and particularly preferably equal to or greater than 8 cm. The length L1 is preferably equal to or less than 20 cm.

What is indicated by a reference sign Ti in FIG. 3 is the thickness of the first vibration-damping portion 6. In light of vibration-damping performance, the thickness T1 is preferably equal to or greater than 0.5 mm and particularly preferably equal to or greater than 0.8 mm. The thickness T1 is preferably equal to or less than 4 mm and particularly preferably equal to or less than 1.5 mm.

As shown in FIG. 1, the head 8 includes two second vibration-damping portions 18. These second vibration-damping portions 18 are located so as to be symmetrical about an axis of the racket frame 2. Each second vibration-damping portion 18 is formed by using a modified epoxy resin in a part of the prepregs used for forming the head 8. In the modified epoxy resin, a loss coefficient measured under the conditions of a temperature of 0° C. and a frequency of 10 Hz is equal to or greater than 0.5.

As shown in FIG. 1, each throat 10 includes a second vibration-damping portion 18. The two second vibration-damping portions 18 are located so as to be symmetrical about the axis of the racket frame 2. Each second vibration-damping portion 18 is formed by using a modified epoxy resin in a part of the prepregs used for forming the throat 10. A modified epoxy resin that is the same as the modified epoxy resin for the second vibration-damping portions 18 in the head 8 is used for the second vibration-damping portions 18 in the throats 10.

In the tennis racket in which the racket frame 2 is used, vibrations generated at hitting are damped by the second vibration-damping portions 18. The tennis racket has excellent feel at impact. With the tennis racket, tennis elbow is unlikely to occur. The material of the second vibration-damping portions 18 is different from the material of the first vibration-damping portions 6. Since the two types of the vibration-damping portions whose materials are different from each other are provided, the racket frame 2 is very excellent in vibration-damping performance.

What is indicated by each reference sign L2 in FIG. 2 is the length of each second vibration-damping portion 18. In light of vibration-damping performance, the length L2 is preferably equal to or greater than 1 cm and particularly preferably equal to or greater than 2 cm. The length L2 is preferably equal to or less than 10 cm.

In the present embodiment, the head 8 and the throats 10 include the second vibration-damping portions 18. Only the head 8 may include the second vibration-damping portions 18, or only each throat 10 may include the second vibration-damping portion 18.

Figure 4:
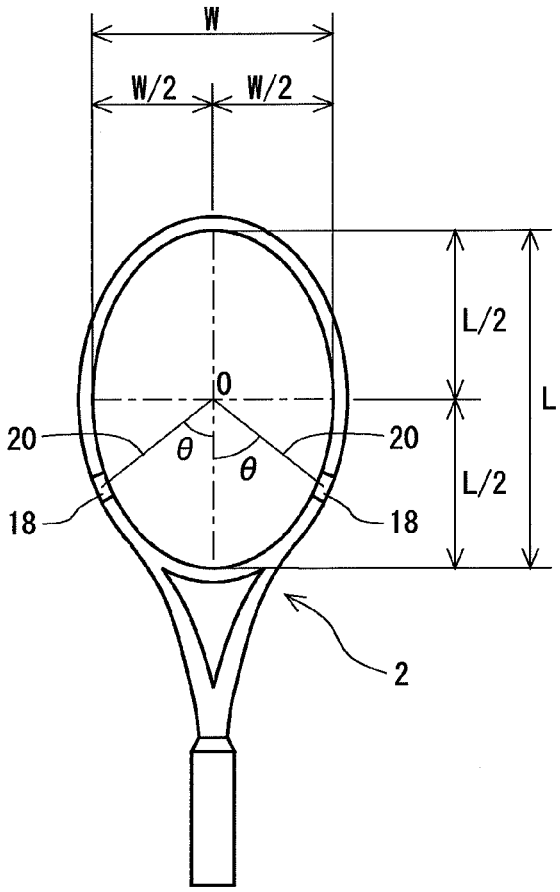
FIG. 4 is a front view for explaining the positions of second vibration-damping portions in the racket frame.

FIG. 4 is a front view for explaining the positions of the second vibration-damping portions 18. What is indicated by each reference sign 20 in FIG. 4 is a straight line connecting the center O of the ball-hitting face to the center of each second vibration-damping portion 18. What is indicated by each reference sign θ is the angle made by each straight line 20 relative to the axial direction. When the ball-hitting face is regarded as the dial of a clock, the second vibration-damping portions 18 whose angles θ are 60° are located at the position of four and the position of eight. The second vibration-damping portions 18 whose angles θ are 90° are located at the position of three and the position of nine. In the racket frame 2 shown in FIG. 1, the angles θ are 90°. In other words, the second vibration-damping portions 18 are located at the position of three and the position of nine.

In light of vibration-damping performance, each angle θ is preferably equal to or greater than 30° and particularly preferably equal to or greater than 45°. In light of vibration-damping performance, each angle θ is preferably equal to or less than 120° and particularly preferably equal to or less than 90°.

Figure 5:
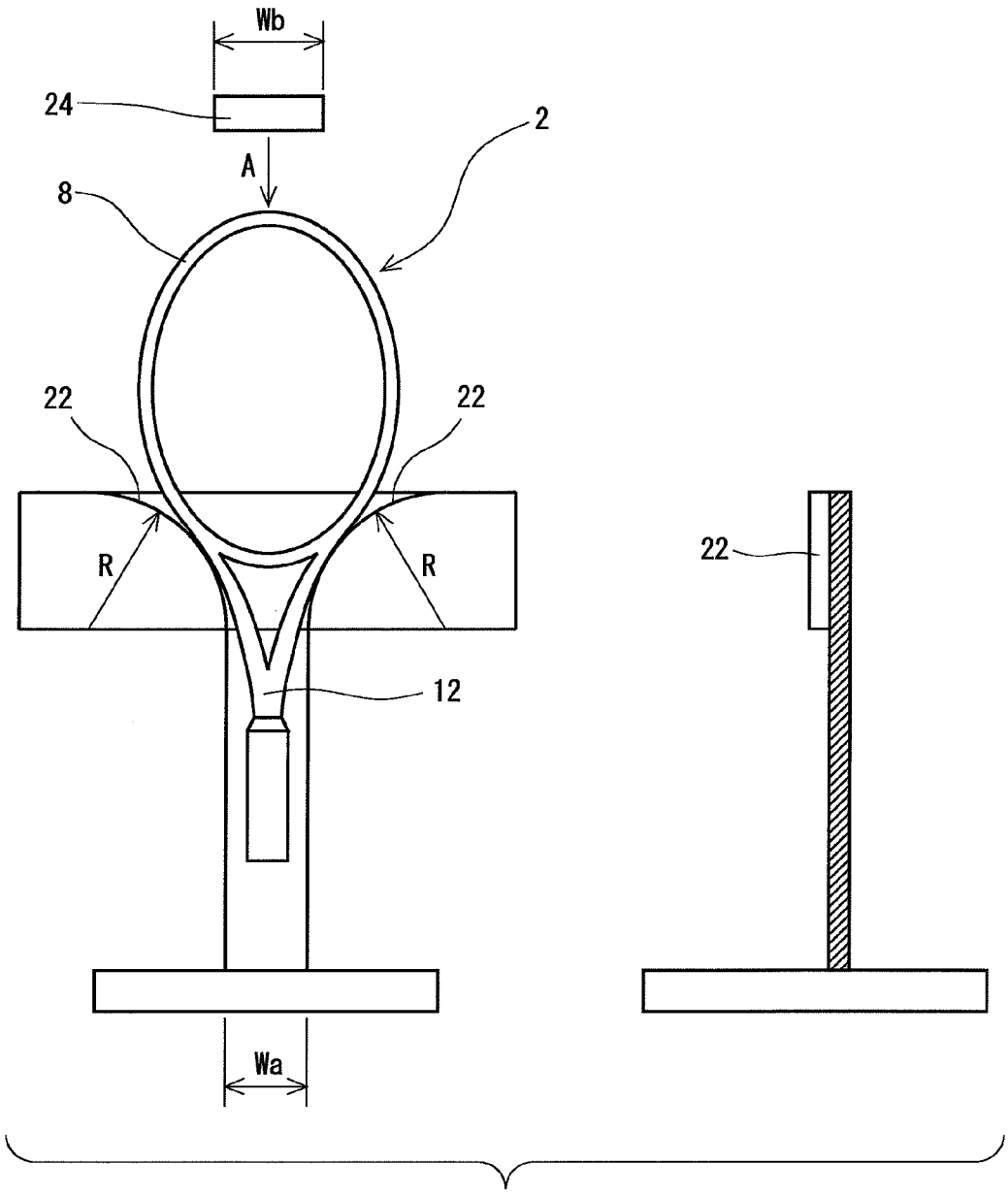
FIG. 5 is a schematic diagram showing a situation in which a top pressure rigidity of the racket frame in FIG. 1 is measured.

FIG. 5 is a schematic diagram showing a situation in which a top pressure rigidity R1 of the racket frame 2 in FIG. 1 is measured. For measuring the top pressure rigidity R1, a pair of receiving tools 22 each having a quarter-circular shape and a radius R of 35 mm are used. These receiving tools 22 are made of steel. The interval Wa between these receiving tools 22 is 80 mm. The racket frame 2 is disposed in the receiving tools 22 such that the shaft 12 vertically extends. Meanwhile, a compressing tool 24 made of steel is prepared. The compressing tool 24 has a cylindrical shape having a diameter Wb of 100 mm. The compressing tool 24 moves at a speed of 30 mm/min in the direction of an arrow A. The compressing tool 24 presses the top of the head 8. Due to this pressing, a load is applied to the racket frame 2. By the movement of the compressing tool 24, the load gradually increases. A movement distance X (mm) of the compressing tool 24 from the state in which the load is 25 kgf to the state in which the load is 50 kgf is measured. A value obtained by dividing 25 kgf by X is the top pressure rigidity R1. The measurement of the top pressure rigidity R1 is conducted in a state in which the grommet is attached to the racket frame 2 having vibration-damping performance and the gut is not mounted on the racket frame 2 having vibration-damping performance.

In light of resilience and operability, the top pressure rigidity R1 is preferably equal to or greater than 110 kgf/mm and particularly preferably equal to or greater than 120 kgf/mm.

In light of feel at impact, the top pressure rigidity R1 is preferably equal to or less than 135 kgf/mm and particularly preferably equal to or less than 130 kgf /mm.

Figure 6:
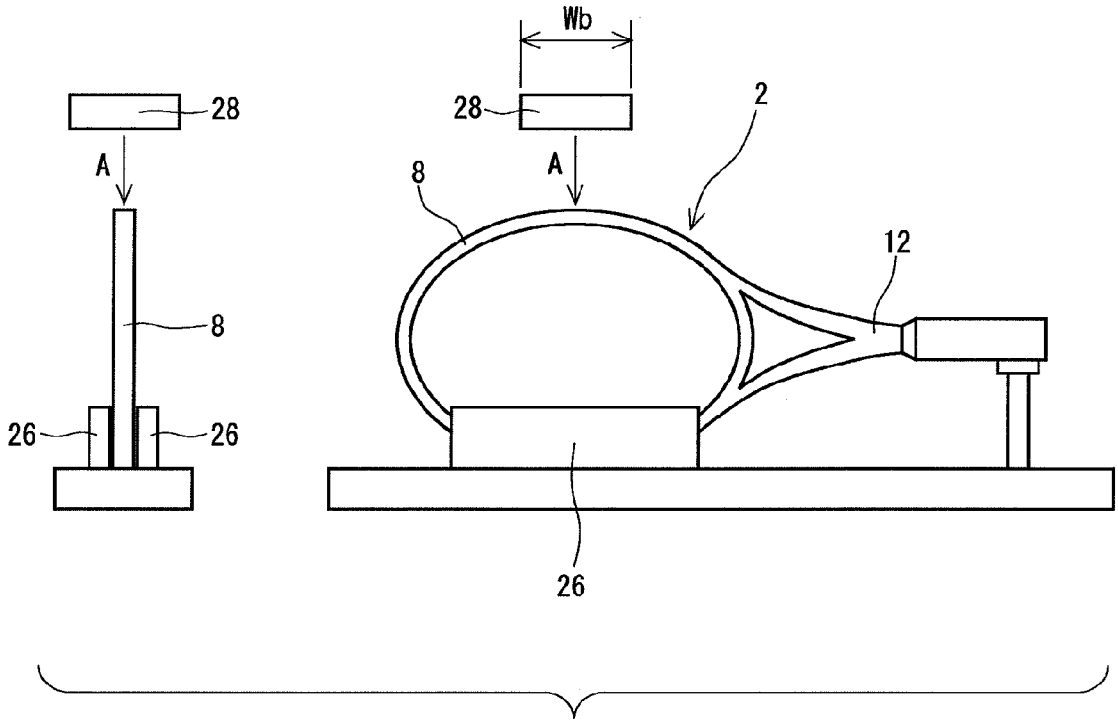
FIG. 6 is a schematic diagram showing a situation in which a side pressure rigidity of the racket frame in FIG. 1 is measured.

FIG. 6 is a schematic diagram showing a situation in which a side pressure rigidity R2 of the racket frame 2 in FIG. 1 is measured. For measuring the side pressure rigidity R2, two pinching plates 26 are used. The racket frame 2 is retained by these pinching plates 26 such that the shaft 12 horizontally extends and the ball-hitting face vertically extends. Meanwhile, a compressing tool 28 made of steel is prepared. The compressing tool 28 has a cylindrical shape having a diameter Wb of 100 mm. The compressing tool 28 moves at a speed of 30 mm/min in the direction of an arrow A. The compressing tool 28 presses a side portion of the head 8. Due to this pressing, a load is applied to the racket frame 2. By the movement of the compressing tool 28, the load gradually increases. A movement distance X (mm) of the compressing tool 28 from the state in which the load is 25 kgf to the state in which the load is 50 kgf is measured. A value obtained by dividing 25 kgf by X is the side pressure rigidity R2. The measurement of the side pressure rigidity R2 is conducted in a state in which the grommet is attached to the racket frame 2 having vibration-damping performance and the gut is not mounted on the racket frame 2 having vibration-damping performance.

In light of resilience and operability, the side pressure rigidity R2 is preferably equal to or greater than 95 kgf/mm and particularly preferably equal to or greater than 100 kgf/mm. In light of feel at impact, the side pressure rigidity R2 is preferably equal to or less than 120 kgf/mm and particularly preferably equal to or less than 110 kgf/mm.

Figure 7:
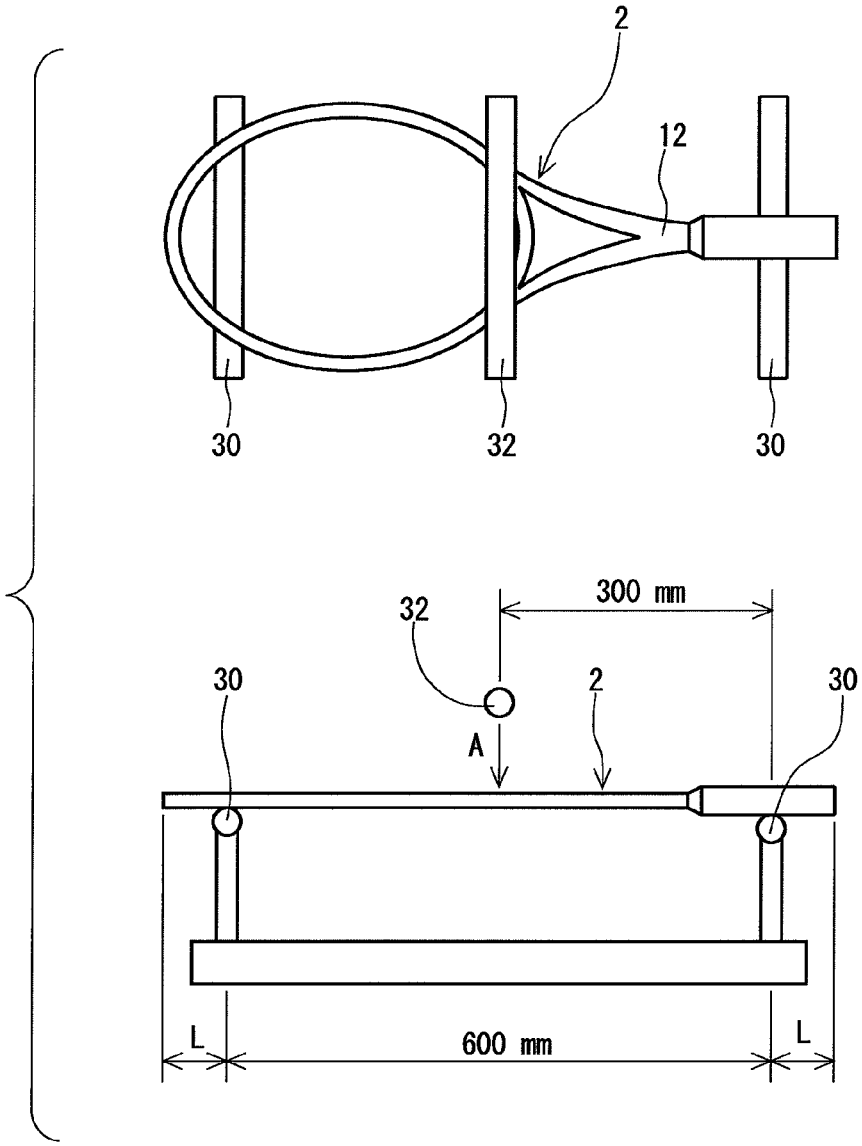
FIG. 7 is a schematic diagram showing a situation in which a plane rigidity of the racket frame in FIG. 1 is measured.

FIG. 7 is a schematic diagram showing a situation in which a plane rigidity R3 of the racket frame 2 in FIG. 1 is measured. For measuring the plane rigidity R3, two receiving tools 30 made of steel are used. Each receiving tool 30 has a bar shape. A cross-sectional shape of each receiving tool 30 is a circle having a radius of 15 mm. These receiving tools 30 are disposed such that the interval therebetween is 600 mm. The racket frame 2 is disposed on these receiving tools 30 such that the shaft 12 horizontally extends and the ball-hitting face horizontally extends. Meanwhile, a compressing tool 32 made of steel is prepared. The compressing tool 32 has a bar shape. A cross-sectional shape of the compressing tool 32 is a circle having a radius of 10 mm. The compressing tool 32 moves at a speed of 30 mm/min in the direction of an arrow A. The compressing tool 32 presses the head 8. Due to this pressing, a load is applied to the racket frame 2. By the movement of the compressing tool 32, the load gradually increases. A movement distance X (mm) of the compressing tool 32 from the state in which the load is 25 kgf to the state in which the load is 50 kgf is measured. A value obtained by dividing 25 kgf by X is the plane rigidity R3. The measurement of the plane rigidity R3 is conducted in a state in which the grommet is attached to the racket frame 2 having vibration-damping performance and the gut is not mounted on the racket frame 2 having vibration-damping performance.

In light of resilience and operability, the plane rigidity R3 is preferably equal to or greater than 50 kgf/mm and particularly preferably equal to or greater than 55 kgf/mm. In light of feel at impact, the plane rigidity R3 is preferably equal to or less than 65 kgf/mm and particularly preferably equal to or less than 60 kgf/mm.

Figure 8:
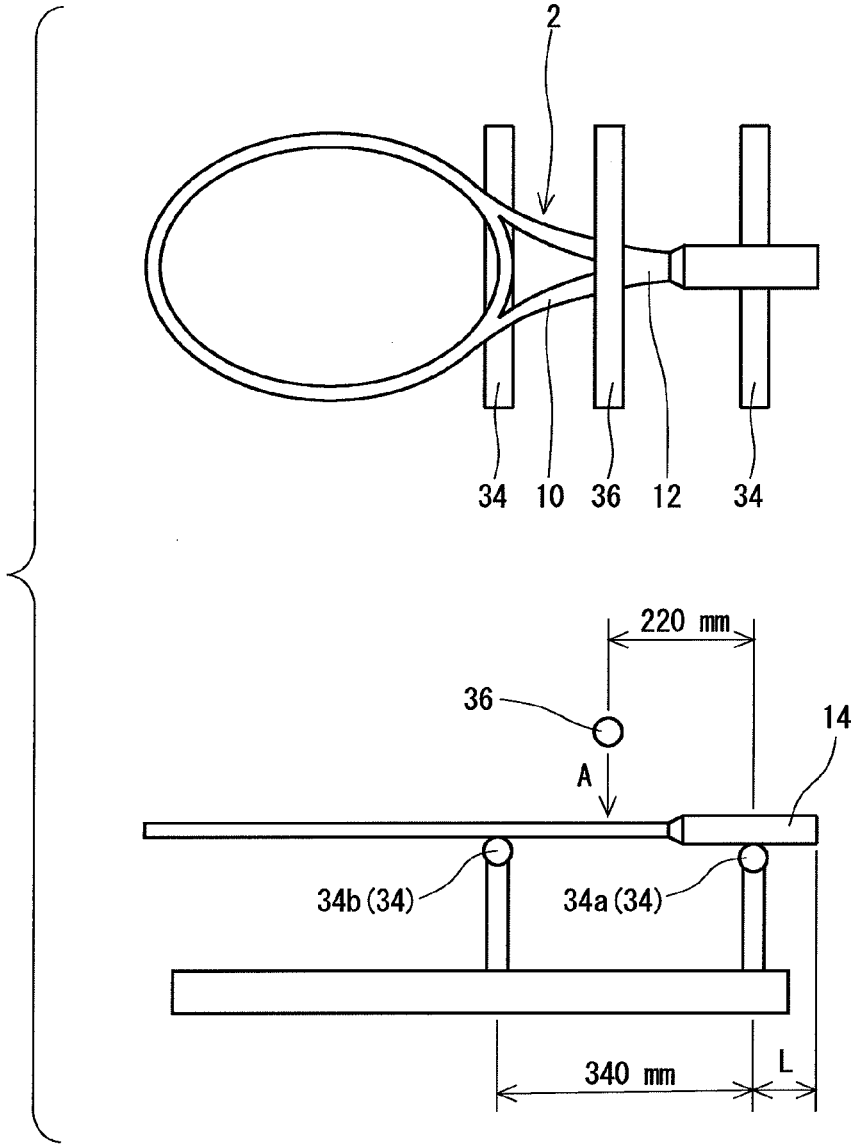
FIG. 8 is a schematic diagram showing a situation in which a throat rigidity of the racket frame in FIG. 1 is measured.

FIG. 8 is a schematic diagram showing a situation in which a throat rigidity R4 of the racket frame 2 in FIG. 1 is measured. For measuring the throat rigidity R4, two receiving tools 34 made of steel are used. Each receiving tool 34 has a bar shape. A cross-sectional shape of each receiving tool 34 is a circle having a radius of 15 mm. The first receiving tool 34*a* is located at a distance L from the end of the grip 14. The second receiving tool 34*b* is located at a distance of 340 mm from the first receiving tool 34*a*. The racket frame 2 is disposed on these receiving tools 34 such that the shaft 12 horizontally extends and the ball-hitting face horizontally extends. Meanwhile, a compressing tool 36 made of steel is prepared. The compressing tool 36 has a bar shape. A cross-sectional shape of the compressing tool 36 is a circle having a radius of 10 mm. The compressing tool 36 moves at a speed of 30 mm/min in the direction of an arrow A. The compressing tool 36 presses the vicinity of the throats 10. Due to this pressing, a load is applied to the racket frame 2. By the movement of the compressing tool 36, the load gradually increases. A movement distance X (mm) of the compressing tool 36 from the state in which the load is 25 kgf to the state in which the load is 50 kgf is measured. A value obtained by dividing 25 kgf by X is the throat rigidity R4. The measurement of the throat rigidity R4 is conducted in a state in which the grommet is attached to the racket frame 2 having vibration-damping performance and the gut is not mounted on the racket frame 2 having vibration-damping performance.

The distance L in FIG. 8 is determined in accordance with the size of the racket frame 2. The distance L corresponding to the size is shown below.

| Size of racket frame | Distance L |
|---|---|
| 27.0 inch | 25 mm |
| 27.5 inch | 38 mm |
| 28.0 inch | 50 mm |
| 28.5 inch | 63 mm |
| 29.0 inch | 75 mm |

In light of resilience and operability, the throat rigidity R4 is preferably equal to or greater than 310 kgf/mm and particularly preferably equal to or greater than 320 kgf/mm. In light of feel at impact, the throat rigidity R4 is preferably equal to or less than 350 kgf/mm and particularly preferably equal to or less than 340 kgf /mm.

Figure 9:
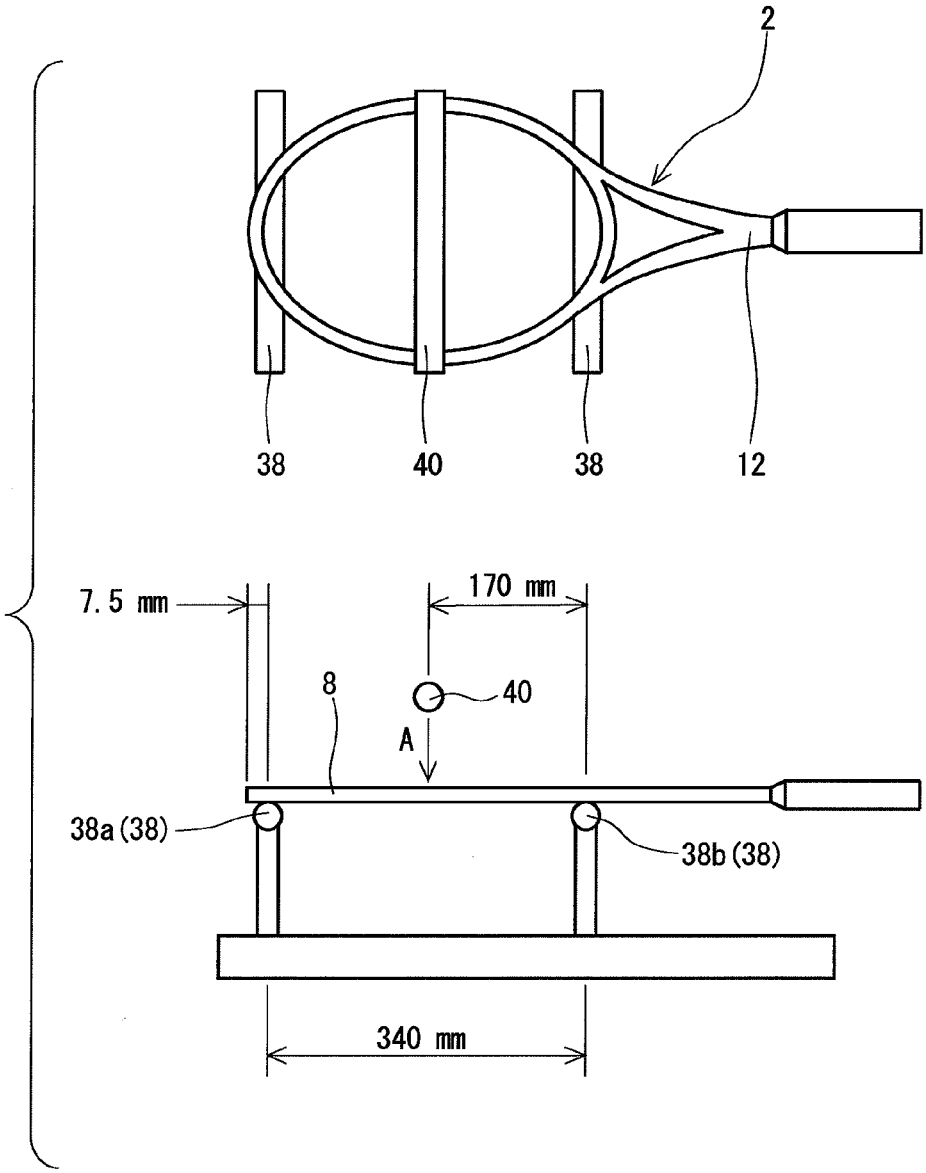
FIG. 9 is a schematic diagram showing a situation in which a ball-hitting face rigidity of the racket frame in FIG. 1 is measured.

FIG. 9 is a schematic diagram showing a situation in which a ball-hitting face rigidity R5 of the racket frame 2 in FIG. 1 is measured. For measuring the ball-hitting face rigidity R5, two receiving tools 38 made of steel are used. Each receiving tool 38 has a bar shape. A cross-sectional shape of each receiving tool 38 is a circle having a radius of 15 mm. The first receiving tool 38*a* is located at a distance of 7.5 mm from the end of the head 8. The second receiving tool 38*b* is located at a distance of 340 mm from the first receiving tool 38*a*. The racket frame 2 is disposed on these receiving tools 38 such that the shaft 12 horizontally extends and the ball-hitting face horizontally extends. Meanwhile, a compressing tool 40 made of steel is prepared. The compressing tool 40 has a bar shape. A cross-sectional shape of the compressing tool 40 is a circle having a radius of 10 mm. The compressing tool 40 moves at a speed of 30 mm/min in the direction of an arrow A. The compressing tool 40 presses the head 8. Due to this pressing, a load is applied to the racket frame 2. By the movement of the compressing tool 40, the load gradually increases. A movement distance X (mm) of the compressing tool 40 from the state in which the load is 25 kgf to the state in which the load is 50 kgf is measured. A value obtained by dividing 25 kgf by X is the ball-hitting face rigidity R5. The measurement of the ball-hitting face rigidity R5 is conducted in a state in which the grommet is attached to the racket frame 2 having vibration-damping performance and the gut is not mounted on the racket frame 2 having vibration-damping performance.

In light of resilience and operability, the ball-hitting face rigidity R5 is preferably equal to or greater than 130 kgf/mm and particularly preferably equal to or greater than 140 kgf/mm. In light of feel at impact, the ball-hitting face rigidity R5 is preferably equal to or less than 170 kgf/mm and particularly preferably equal to or less than 160 kgf/mm.

The ratio (R2/R4) of the side pressure rigidity R2 to the throat rigidity R4 is preferably equal to or greater than 0.26. The racket frame 2 in which the ratio (R2/R4) is equal to or greater than 0.26 has both excellent feel at impact and excellent resilience. In this respect, the ratio (R2/R4) is more preferably equal to or greater than 0.28 and particularly preferably equal to or greater than 0.31. The ratio (R2/R4) that can be achieved in a practical racket frame 2 is equal to or less than 0.40.

Figure 10:
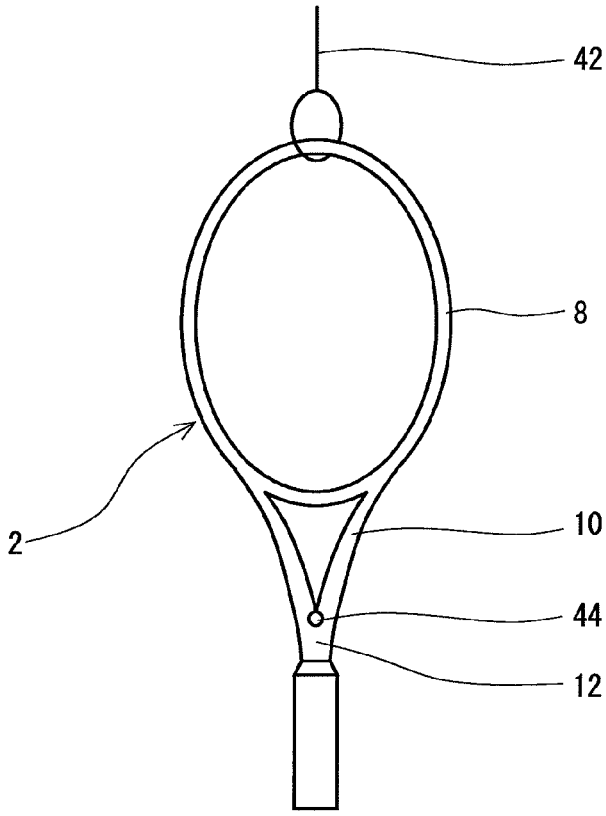
FIG. 10 is a schematic diagram showing a situation in which a vibration damping rate in an out-of-plane secondary mode of the racket frame in FIG. 1 is measured.
Figure 11:
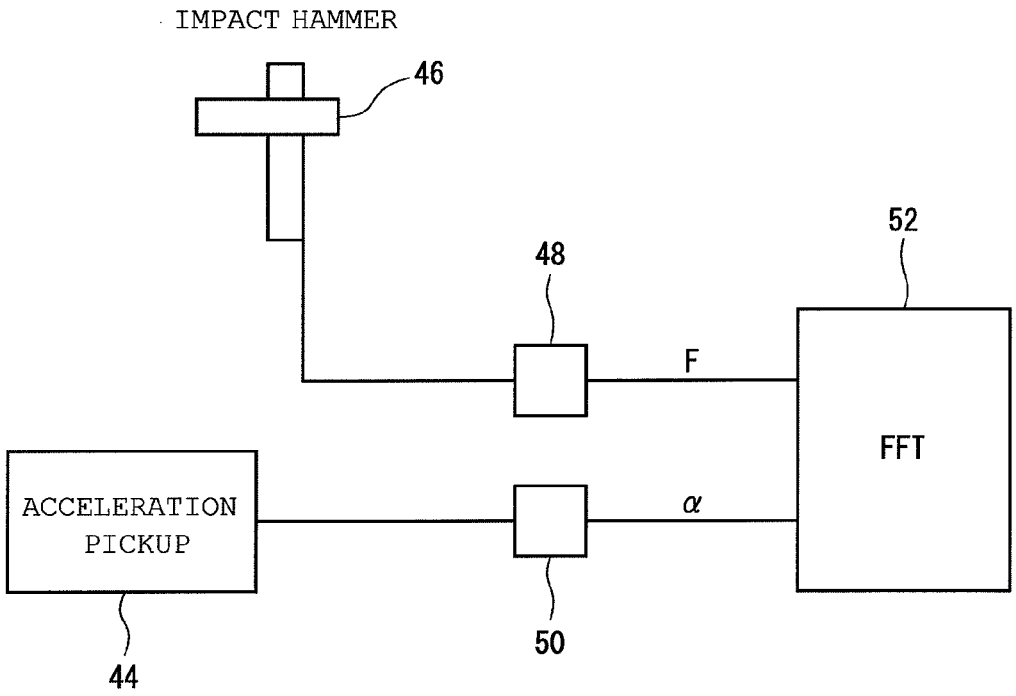
FIG. 11 is a conceptual diagram of an apparatus used for the measurement in FIG. 10.
Figure 12:
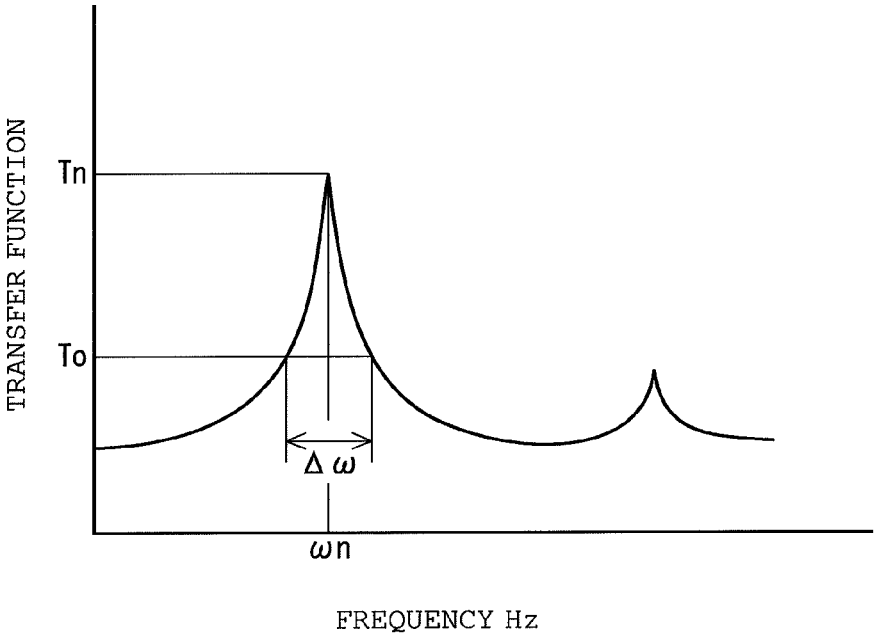
FIG. 12 is a graph showing a result obtained by the measurement in FIG. 10.

FIG. 10 is a schematic diagram showing a situation in which a vibration damping rate in an out-of-plane secondary mode of the racket frame 2 in FIG. 1 is measured. FIG. 11 is a conceptual diagram of an apparatus used for the measurement in FIG. 10. In the measurement, the upper end of the head 8 is hung with a string 42. An acceleration pickup 44 is fixed to the boundary between the throats 10 and the shaft 12. The acceleration pickup 44 is attached such that a measurement direction thereof is perpendicular to the ball-hitting face. The back side of the acceleration pickup 44 on the racket frame 2 is hit with an impact hammer 46. A force pickup meter is attached to the impact hammer 46. Response vibration (F) measured by the force pickup meter and response vibration (a) measured by the acceleration pickup 44 are inputted to a frequency analyzer 52 via amplifiers 48 and 50, respectively. These vibrations are analyzed by the frequency analyzer 52. The response vibration (F) is an input vibrating force. The response vibration (a) is response acceleration. As the frequency analyzer 52, dynamic single analyzer HP3562A manufactured by Hewlett-Packard Development Company, L.P. is used. By this analysis, a transfer function is obtained. An example of a graph of the transfer function is shown in FIG. 12. In this graph, the horizontal axis indicates a frequency (Hz), and the vertical axis indicates the transfer function. The transfer function is [response vibration (α)/response vibration (F)]. By this measurement, a transfer function of the out-of-plane secondary mode is obtained. A vibration damping rate Rv is calculated by the following equations (1) and (2).

$$Rv=(1/2)\times(\Delta\omega/\omega n) \quad (1)$$

$$T0=Tn/\sqrt{2} \quad (2)$$

In the equation (1), ωn is the frequency of a primary maximal value.

The vibration damping rate in the out-of-plane secondary mode is preferably equal to or greater than 0.70 and particularly preferably equal to or greater than 0.80. In light of resilience, the vibration damping rate is preferably equal to or less than 1.0.

Figure 13:
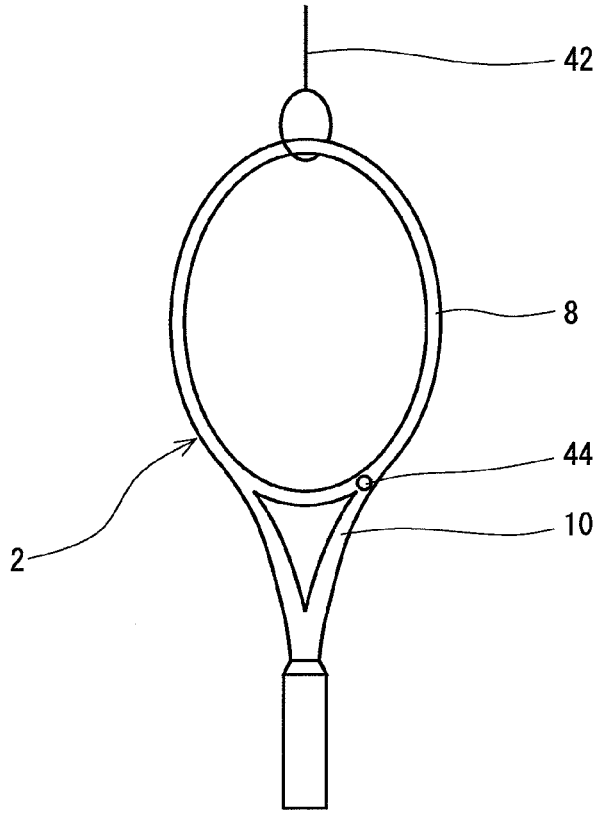
FIG. 13 is a schematic diagram showing a situation in which a vibration damping rate in an out-of-plane primary mode of the racket frame in FIG. 1 is measured.

FIG. 13 is a schematic diagram showing a situation in which a vibration damping rate in an out-of-plane primary mode of the racket frame 2 in FIG. 1 is measured. In the measurement, the acceleration pickup 44 is fixed to the boundary between the head 8 and the throat 10. The acceleration pickup 44 is attached such that the measurement direction thereof is perpendicular to the ball-hitting face. The back side of the acceleration pickup 44 on the racket frame 2 is hit with the impact hammer 46 (see FIG. 11). Then, the vibration damping rate in the out-of-plane primary mode is calculated by the same method as that for the measurement of the vibration damping rate in the out-of-plane secondary mode.

The vibration damping rate in the out-of-plane primary mode is preferably equal to or greater than 0.50 and particularly preferably equal to or greater than 0.60. In light of resilience, the vibration damping rate is preferably equal to or less than 0.80.

Figure 14:
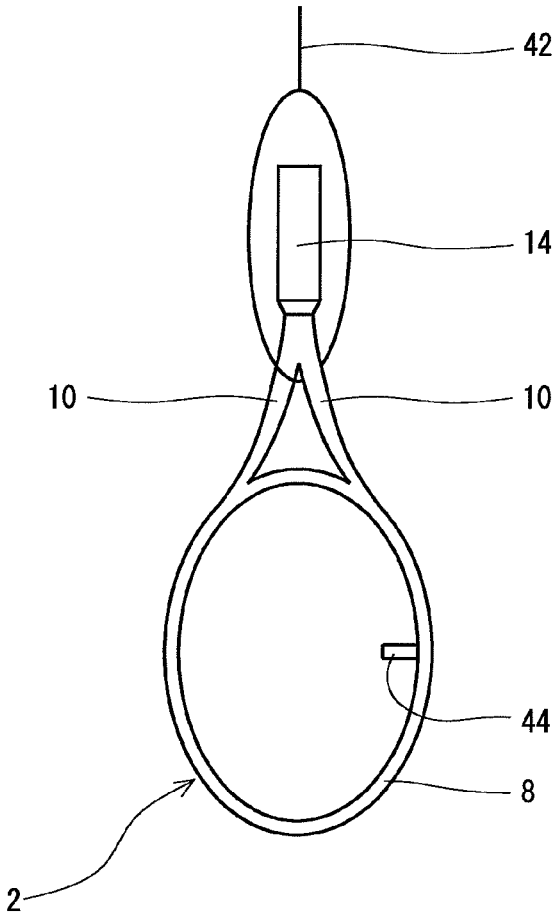
FIG. 14 is a schematic diagram showing a situation in which a vibration damping rate in an in-plane secondary mode of the racket frame in FIG. 1 is measured.

FIG. 14 is a schematic diagram showing a situation in which a vibration damping rate in an in-plane secondary mode of the racket frame 2 in FIG. 1 is measured. In the measurement, the portion where the throats 10 are connected to each other is hooked on a string, whereby the racket frame 2 is hung therefrom. In the hung racket frame 2, the head 8 is located on the lower side, and the grip 14 is located on the upper side. The acceleration pickup 44 is fixed to the inside of a side portion of the head 8. The acceleration pickup 44 is attached such that the measurement direction thereof is parallel to the ball-hitting face. The back side of the acceleration pickup 44 on the racket frame 2 is hit with the impact hammer 46. Then, the vibration damping rate in the in-plane secondary mode is calculated by the same method as that for the measurement of the vibration damping rate in the out-of-plane secondary mode.

The vibration damping rate in the in-plane secondary mode is preferably equal to or greater than 1.3 and particularly preferably equal to or greater than 1.5. In light of resilience, the vibration damping rate is preferably equal to or less than 2.0.

In light of operability, a moment of inertia around the axis at a position of 10 cm from the grip end is preferably less than 300 kg·cm$^2$ and particularly preferably less than 295 kg·cm$^2$. The moment of inertia that can be achieved in a practical racket frame 2 is equal to or greater than 250 kg·cm$^2$. The moment of inertia is measured by racket diagnostic center manufactured by Babolat VS.

In light of resilience, the weight of the racket frame 2 is preferably equal to or greater than 300 g and particularly preferably equal to or greater than 310 g. In light of operability, the weight is preferably equal to or less than 340 g and particularly preferably equal to or less than 330 g.

EXAMPLES

The following will show the effects of the present invention by means of Examples, but the present invention should not be construed in a limited manner based on the description of these Examples.

Example 1

The racket frame shown in FIGS. 1 to 3 was manufactured. The racket frame includes first vibration-damping portions, second vibration-damping portions in the head thereof, and second vibration-damping portions in the throats thereof. The angles θ of the second vibration-damping portions in the head are 90°. In other words, the second vibration-damping portions in the head are located at the position of three and the position of nine.

Example 2

A racket frame of Example 2 was obtained in the same manner as Example 1, except the positions of the second vibration-damping portions in the head were as shown in Table 1 below.

Examples 3 and 4

A racket frame of Example 3 was obtained in the same manner as Example 1, except no second vibration-damping portions were provided in the throats. A racket frame of Example 4 was obtained in the same manner as Example 1, except no second vibration-damping portions were provided in the head.

Comparative Examples 1 to 3

A racket frame of Comparative Example 1 was obtained in the same manner as Example 1, except no first vibration-damping portions were provided. A racket frame of Comparative Example 2 was obtained in the same manner as Example 1, except no second vibration-damping portions were provided. A racket frame of Comparative Example 3 was obtained in the same manner as Example 1, except no first vibration-damping portions and no second vibration-damping portions were provided.

Examples 5 and 6

Racket frames of Examples 5 and 6 were obtained in the same manner as Example 1, except the weight and the positions of the second vibration-damping portions in the head were as shown in Tables 2 and 3 below.

Comparative Examples 4 to 6

Racket frames of Comparative Examples 4 to 6 are commercially available racket frames. The racket frame of Comparative Example 4 includes second vibration-damping portions in a shaft thereof. In the racket frame of Comparative Example 5, a matrix is a nylon obtained by reaction injection molding, and a reinforced fiber is a carbon long fiber. In the racket frame of Comparative Example 6, a carbon short fiber is dispersed in a nylon matrix.

[Evaluation]

Grommets, grip tapes, end caps, and guts were mounted onto the racket frames to produce tennis rackets. Ten advanced players conducted rallies with the tennis rackets and were asked about feel at impact, resilience, and operability. The evaluation was categorized as follows on the basis of the number of players who answered, "good".

A: 8 or more
B: 6 or 7
C: 4 or 5
D: 3 or less

The results are shown in Tables 1 to 3.

TABLE 1

Result of Evaluation

| | | Example 1 | Example 2 | Example 3 | Example 4 |
|---|---|---|---|---|---|
| Weight (g) | | 320 | 320 | 320 | 320 |
| First vibration-damping portions | | Presence | Presence | Presence | Presence |
| Second vibration-damping portions in head | | Presence | Presence | Presence | None |
| θ (degree) | | 90 | 60 | 90 | — |
| Second vibration-damping portions in throats | | Presence | Presence | None | Presence |
| Balance (mm) | | 305 | 305 | 305 | 305 |
| Moment of inertia (kg · cm$^2$) | | 290 | 288 | 287 | 285 |
| Top pressure rigidity R1 (kgf/mm) | | 124 | 117 | 120 | 118 |
| Side pressure rigidity R2 (kgf/mm) | | 103 | 104 | 104 | 105 |
| Plane rigidity R3 (kgf/mm) | | 57 | 56 | 57 | 56 |
| Throat rigidity R4 (kgf/mm) | | 331 | 338 | 335 | 336 |
| Ball-hitting face rigidity R5 (kgf/mm) | | 158 | 142 | 150 | 148 |
| R2/R4 | | 0.31 | 0.31 | 0.31 | 0.31 |
| Vibration damping rate | Out-of-plane primary | 0.65 | 0.63 | 0.52 | 0.62 |
| | Out-of-plane secondary | 0.84 | 0.78 | 0.74 | 0.70 |
| | In-plane secondary | 1.55 | 1.50 | 1.40 | 1.35 |
| Vibration-damping performance | | A | A | B | B |
| Resilience | | B | B | A | A |
| Operability | | A | A | A | A |

TABLE 2

Result of Evaluation

| | Comparative Example 1 | Comparative Example 2 | Comparative Example 3 | Example 5 |
|---|---|---|---|---|
| Weight (g) | 320 | 320 | 320 | 315 |
| First vibration-damping portions | None | Presence | None | Presence |
| Second vibration-damping portions in head | Presence | None | None | Presence |
| θ (degree) | 90 | — | — | 90 |
| Second vibration-damping portions in throats | Presence | None | None | Presence |
| Balance (mm) | 305 | 305 | 305 | 310 |
| Moment of inertia (kg · cm$^2$) | 291 | 290 | 289 | 290 |
| Top pressure rigidity R1 (kgf/mm) | 120 | 119 | 122 | 115 |
| Side pressure rigidity R2 (kgf/mm) | 105 | 102 | 104 | 101 |
| Plane rigidity R3 (kgf/mm) | 56 | 57 | 57 | 56 |
| Throat rigidity R4 (kgf/mm) | 330 | 334 | 331 | 327 |
| Ball-hitting face rigidity R5 (kgf/mm) | 151 | 149 | 155 | 145 |
| R2/R4 | 0.32 | 0.31 | 0.31 | 0.31 |

TABLE 2-continued

| Result of Evaluation | | | | | |
|---|---|---|---|---|---|
| | | Comparative Example 1 | Comparative Example 2 | Comparative Example 3 | Example 5 |
| Vibration damping rate | Out-of-plane primary | 0.47 | 0.45 | 0.38 | 0.72 |
| | Out-of-plane secondary | 0.62 | 0.60 | 0.52 | 0.85 |
| | In-plane secondary | 0.95 | 1.20 | 0.87 | 1.55 |
| Vibration-damping performance | | C | C | D | A |
| Resilience | | B | B | A | B |
| Operability | | A | A | A | A |

TABLE 3

| Result of Evaluation | | | | | |
|---|---|---|---|---|---|
| | | Example 6 | Comparative Example 4 | Comparative Example 5 | Comparative Example 6 |
| Weight (g) | | 315 | 310 | 327 | 356 |
| First vibration-damping portions | | Presence | None | None | None |
| Second vibration-damping portions in head | | Presence | None | None | None |
| θ (degree) | | 60 | — | None | None |
| Second vibration-damping portions in throats | | Presence | * | None | None |
| Balance (mm) | | 310 | 315 | 300 | 300 |
| Moment of inertia (kg · $cm^2$) | | 292 | 295 | 303 | 319 |
| Top pressure rigidity R1 (kgf/mm) | | 116 | 115 | 125 | 94 |
| Side pressure rigidity R2 (kgf/mm) | | 103 | 86 | 92 | 58 |
| Plane rigidity R3 (kgf/mm) | | 56 | 56 | 54 | 30 |
| Throat rigidity R4 (kgf/mm) | | 325 | 349 | 375 | 256 |
| Ball-hitting face rigidity R5 (kgf/mm) | | 142 | 146 | 154 | 166 |
| R2/R4 | | 0.32 | 0.25 | 0.24 | 0.22 |
| Vibration damping rate | Out-of-plane primary | 0.64 | 0.27 | 0.96 | 1.34 |
| | Out-of-plane secondary | 0.80 | 0.44 | 0.99 | 1.24 |
| | In-plane secondary | 1.58 | 0.48 | 1.59 | 1.36 |
| Vibration-damping performance | | A | D | A | A |
| Resilience | | B | B | C | D |
| Operability | | A | B | C | D |

* Second vibration-damping portions were present in the shaft.

As shown in Tables 1 to 3, the racket frames of Examples are excellent in various performance characteristics. From the results of evaluation, advantages of the present invention are clear.

The above descriptions are merely for illustrative examples, and various modifications can be made without departing from the principles of the present invention.

What is claimed is:

1. A racket frame comprising a body and a first vibration-damping portion fixed to the body, wherein the body includes a head, a shaft, a pair of throats extending from the head to the shaft, and a grip connected to the shaft, the body includes a second vibration-damping portion, a material of the second vibration-damping portion is different from a material of the first vibration-damping portion, a ratio (R2/R4) of a side pressure rigidity R2 to a throat rigidity R4 is equal to or greater than 0.26, a moment of inertia around an axis at a position of 10 cm from a grip end is less than 300 kg·$cm^2$, and a vibration damping rate in an out-of-plane secondary mode is equal to or greater than 0.70 but equal to or less than 1.0.

2. The racket frame according to claim 1, wherein the first vibration-damping portion is formed from a fiber reinforced nylon.

3. The racket frame according to claim 1, wherein the second vibration-damping portion is formed from an epoxy resin.

4. The racket frame according to claim 1, wherein the first vibration-damping portion is fixed to each throat, the shaft, or the grip, and the second vibration-damping portion is included in the head or each throat.

5. The racket frame according to claim 4, wherein the first vibration-damping portion extends from each throat to the grip.

6. The racket frame according to claim 4, wherein the head includes a pair of second vibration-damping portions, and these second vibration-damping portions are located so as to be symmetrical about the axis of the racket frame.

7. The racket frame according to claim 4, wherein each throat includes the second vibration-damping portion, and these second vibration-damping portions are located so as to be symmetrical about the axis of the racket frame.

8. The racket frame according to claim 1, wherein the side pressure rigidity R2 is equal to or greater than 95 kgf/cm, and the throat rigidity R4 is equal to or less than 350 kgf/cm.

9. The racket frame according to claim 1, wherein the ratio (R2/R4) is equal to or greater than 0.28.

10. The racket frame according to claim 1, wherein the moment of inertia is less than 295 kg·$cm^2$.

* * * * *